US006532629B2

(12) United States Patent
Armstrong

(10) Patent No.: US 6,532,629 B2
(45) Date of Patent: Mar. 18, 2003

(54) DUMMY KNOB

(75) Inventor: Steven Armstrong, Anaheim, CA (US)

(73) Assignee: Newfrey LLC, Newark, DE (US)

( * ) Notice: Subject to any disclaimer, the term of this patent is extended or adjusted under 35 U.S.C. 154(b) by 56 days.

(21) Appl. No.: 09/755,921

(22) Filed: Jan. 5, 2001

(65) Prior Publication Data

US 2002/0088084 A1 Jul. 11, 2002

(51) Int. Cl.[7] ..... E05B 1/00

(52) U.S. Cl. ..... 16/414; 16/441; 16/422; 292/348; 292/352; 292/355

(58) Field of Search ..... 16/414, 422, 441; 403/315, 316, 317; 292/347, 348, 349, 352, 355

(56) References Cited

U.S. PATENT DOCUMENTS

| | | | | |
|---|---|---|---|---|
| 2,593,264 A | | 4/1952 | Cerf, Jr. | |
| 2,759,754 A | | 8/1956 | Kaiser | |
| 2,801,123 A | * | 7/1957 | Kubik et al. | 292/352 |
| 2,827,323 A | | 3/1958 | Kessel et al. | |
| 2,842,389 A | * | 7/1958 | Muttart | 292/352 |
| 3,091,490 A | * | 5/1963 | Williams | 292/352 |
| 3,695,664 A | * | 10/1972 | Nolin | 292/352 |
| 3,779,590 A | | 12/1973 | Sanders et al. | |
| 4,062,579 A | * | 12/1977 | Potter et al. | 292/169.15 |
| 4,437,695 A | * | 3/1984 | Foshee | 292/169.16 |
| 4,588,221 A | * | 5/1986 | Miller et al. | 292/348 |
| 4,639,026 A | * | 1/1987 | Smallegan | 292/169.23 |
| 5,118,152 A | | 6/1992 | Lin | |
| 5,190,327 A | * | 3/1993 | Lin | 292/348 |
| 5,316,355 A | * | 5/1994 | Hartwell et al. | 292/347 |
| 5,409,278 A | | 4/1995 | Harcourt | |
| 5,960,517 A | | 10/1999 | Sprekeler | |

FOREIGN PATENT DOCUMENTS

| | | | |
|---|---|---|---|
| DE | 3604115 A1 | * | 9/1986 |
| WO | WO 99/27216 | * | 6/1999 |

* cited by examiner

*Primary Examiner*—Chuck Mah
(74) *Attorney, Agent, or Firm*—Richard J. Veltman; John D. Del Ponti

(57) ABSTRACT

A quick install dummy doorknob or lever comprises an exterior knob sub-assembly, an interior rose liner coupled to the exterior knob assembly, a knob catch, a retainer spring, and an interior knob. The knob catch is disposed inside the interior rose liner and includes a tooth for engaging the interior knob. The interior rose liner engages a pair of screws extending from the exterior knob sub-assembly. Rotation of the interior rose liner relative to the screws places the screws into retaining apertures in the interior liner, whereupon the screws can be tightened to hold the interior rose liner in position. The interior knob is inserted into a recess formed in the interior rose liner and engages the tooth on the knob catch through a slot formed in the recess.

33 Claims, 5 Drawing Sheets

DUMMY KNOB

BACKGROUND AND SUMMARY OF THE INVENTION

In certain circumstances, such as closet doors and the like where a latch is not used to keep the door closed, it is desirable to install a dummy knob or lever. Typically, a dummy knob or lever is cheaper to install because it has fewer parts.

Unfortunately, for several reasons, the installation of conventional dummy knobs and levers is considered troublesome to consumers. In a conventional installation, the interconnection between the interior and exterior rose assemblies is established by the use of threaded fasteners. The exterior rose assembly typically includes two internally threaded bosses that align with two apertures formed on the interior rose assembly. Standard machine screws are inserted into the interior rose apertures and are brought into alignment with and threadingly engage the threaded bosses formed on the exterior rose assembly. Tightening the screws closes the interior and exterior roses toward each other, thereby trapping the door therebetween.

There are numerous disadvantages to this conventional method of establishing a semi-permanent mechanical connection between the interior and exterior rose assemblies. In particular, the access to the screw heads may be partially concealed behind the doorknob making manipulation awkward. In addition, the screws typically used for this purpose are relatively long (often 1 inch or more in total length) to permit a single lockset to accommodate doors of varying thicknesses, typically in the range of 1⅛ to 1¾ inches. The length of the screws requires that the screws be turned many times when the doorknob or lever is being installed on thinner doors, thereby reducing the speed of installation. Furthermore, the bosses must be internally threaded deeply enough to accommodate the length of the screws when the doorknob or lever is installed on thinner doors. Such deep internally threaded features are difficult to produce in high volume and add to the cost of manufacture.

The use of conventional machine screws in the installation of the doorknob or lever requires that the installer have an appropriate tool available to drive the screws. The use of such tools in connection with the awkward access to the screw heads due to concealment by the doorknob creates significant risk of cosmetic damage to the interior rose should the tool slip off the screw head. If such damage occurs, the installer may be required to remove and replace the interior rose and knob assembly, particularly in new construction applications. Moreover, the risk of cosmetic damage also discourages the use of power drivers, thereby further reducing the speed of installation.

One attempt to overcome these disadvantages is disclosed in U.S. Pat. No. 5,960,517 to Sprekeler. Sprekeler discloses a knob set that includes a knob with an associated rosette and a mounting plate assembly which is attached to the door by fastening to the door surface. The mounting plate assembly includes two disc portions and an internal diametrally mounted slide plate disposed between the two disc portions. A compression spring urges the slide plate to an engaging position. A pair of lugs projecting from a backing plate formed as part of the rosette engage matching rectangular openings in the slide plate and one of the disc members. The two discs are screwed together from behind to form the mounting plate assembly, and then the mounting plate assembly is screwed to the door from the front. A second mounting plate assembly is screwed to the other side of the door to complete the doorknob assembly.

Sprekeler's device has several disadvantages. First, each mounting plate assembly includes eight parts, including the spring and screws, which increases inventory costs and the number of manufacturing steps necessary to assemble it. Second, the mounting plate assembly has to be screwed to the door which mars the door and possibly ruins the door for using any other type of knob or lever or handleset. Third, using two full size discs to sandwich the slide plate consumes extra material, thereby increasing manufacturing costs.

Accordingly, a dummy knob assembly that can be easily and quickly installed by a consumer without fear of marring the door or the finish of the doorknob or lever would be welcome by consumers. Moreover, if fewer parts and less material was needed to manufacture the knob assembly, manufacturers could produce such a knob assembly less expensively, thereby benefiting the manufacturer and consumer alike.

SUMMARY OF THE INVENTION

The present invention overcomes these and other disadvantages by providing a dummy doorknob or lever that can be quickly and easily installed and uninstalled.

The dummy doorknob or lever comprises an assembly with an exterior knob sub-assembly, an interior rose liner coupled to the exterior knob assembly, a knob catch, a retainer spring, and an interior knob coupled to the knob catch. The interior rose liner includes a pair of annular sleeves and a first boss and the knob catch includes a first projection and a second projection, with the first projection engaging the first boss and the second projection being disposed between the annular sleeves.

The interior rose liner includes a second boss and a stem extending from the boss and the interior knob includes a shank configured to receive the stem. The knob catch includes a central portion defining a central opening configured to receive the second boss and a tooth that extends into the central opening. The second boss includes a slot for receiving the tooth, with the tooth extending into the slot to engage the shank.

The spring is disposed adjacent the knob catch. The knob catch includes a tab extending from the second projection and the spring engages the tab to bias the knob catch toward a locking position. The spring includes a pair of projections that engage the annular sleeves to retain the spring in position adjacent the knob catch.

Other features and advantages will become apparent from the following description when viewed in accordance with the accompanying drawings and appended claims.

DETAILED DESCRIPTION OF THE DRAWINGS

With reference to the figures, the present invention is directed to a doorknob or lever mechanism that can be readily secured to door assemblies having various thicknesses and includes certain design features that facilitate proper alignment of the interior and exterior rose assemblies thereof and rapid assembly and installation thereof.

Figure 1:
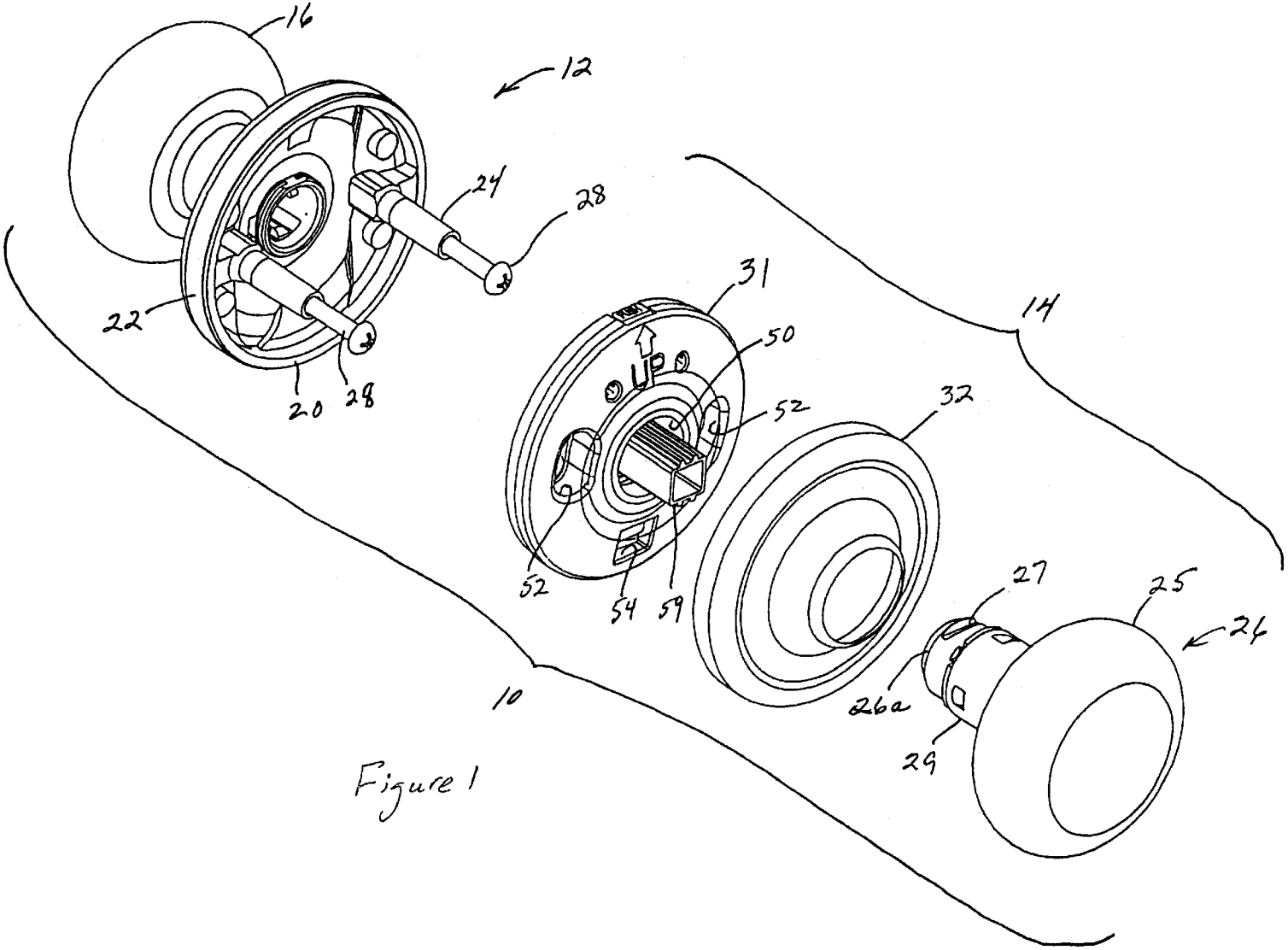
FIG. 1 is an exploded view of a quick install dummy knob assembly according to the present invention.
Figure 2:
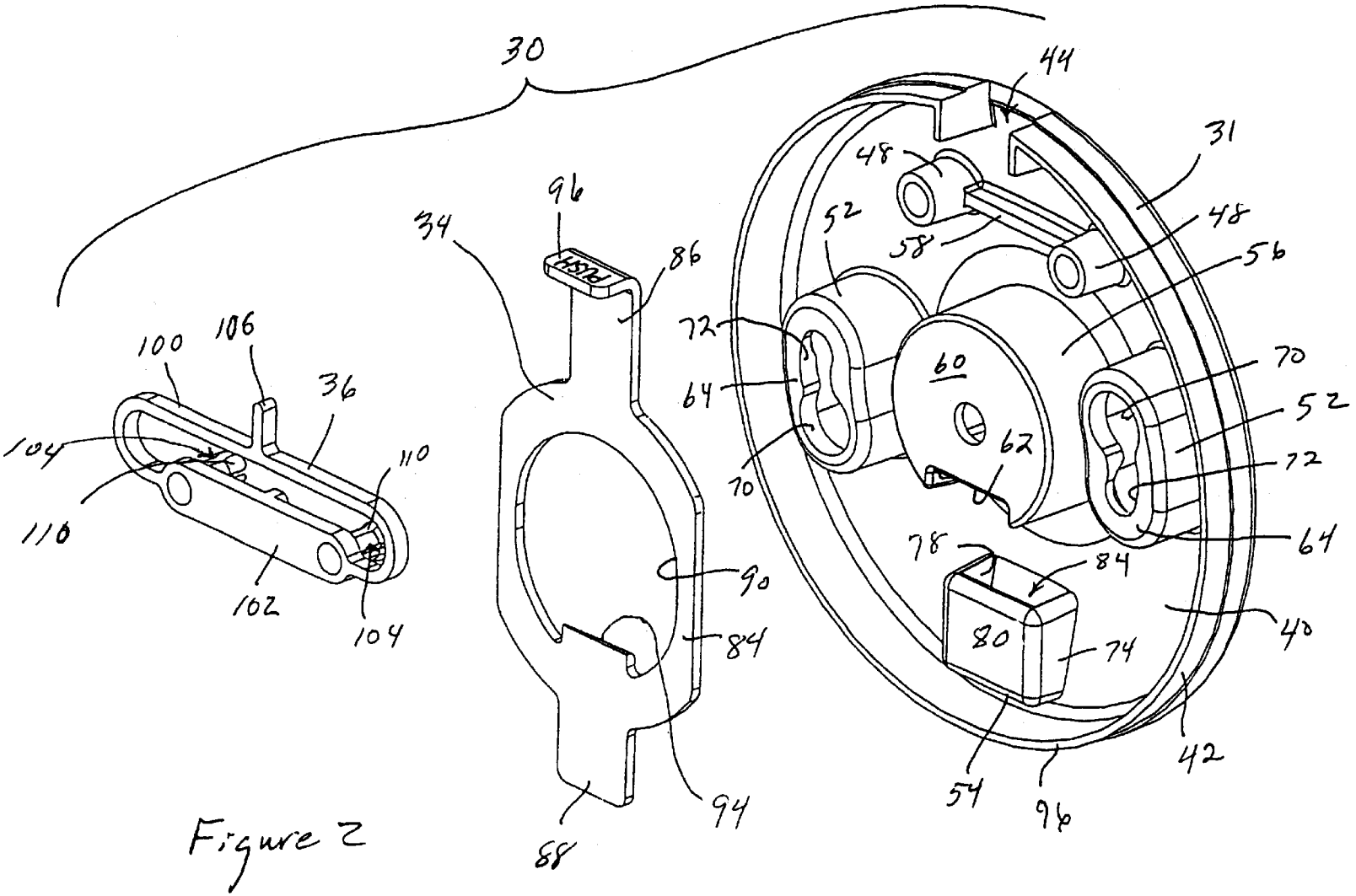
FIG. 2 is an exploded view of an interior knob sub-assembly.
Figure 3:
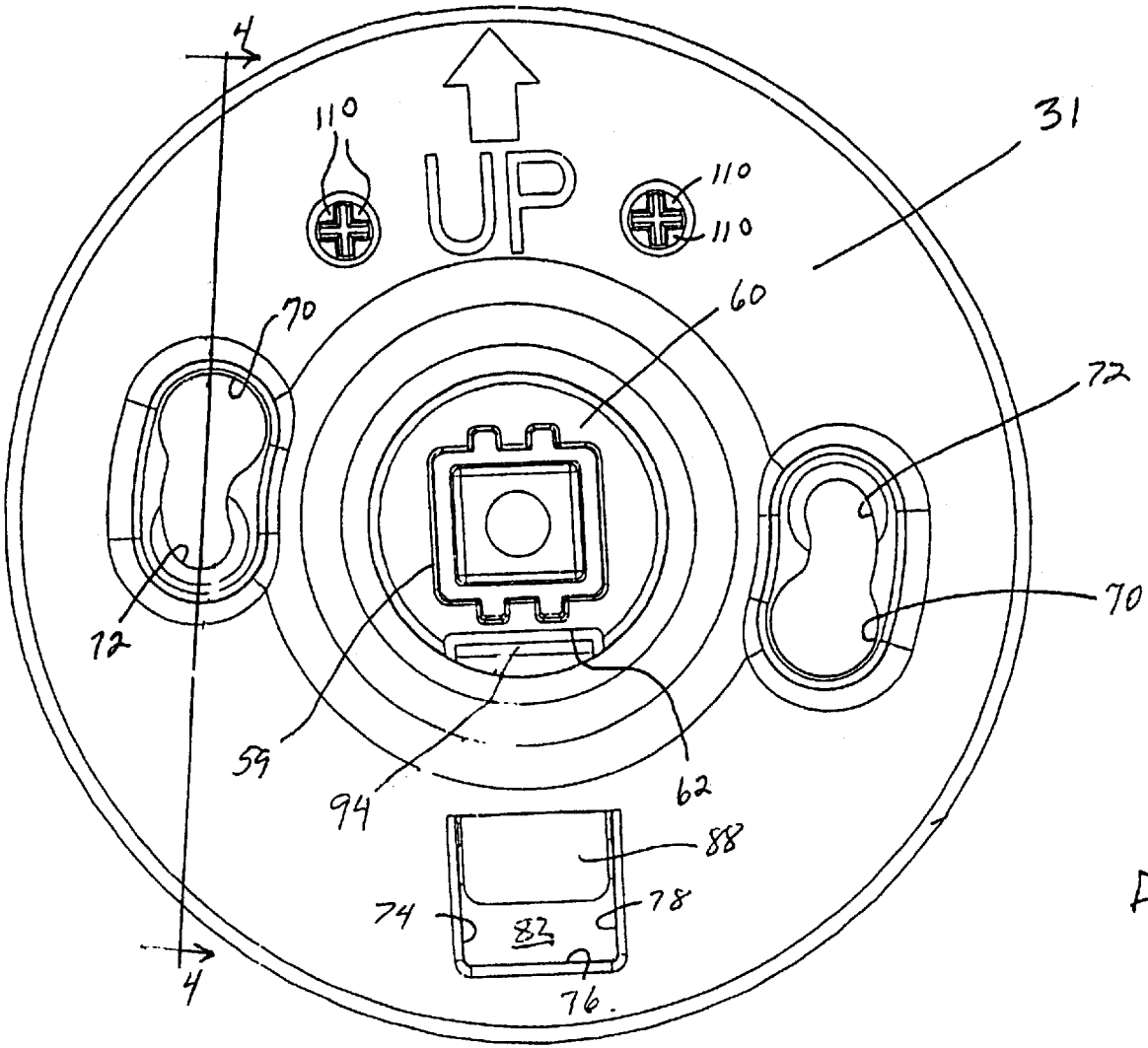
FIG. 3 is a plan view of the interior rose liner.
Figure 4:
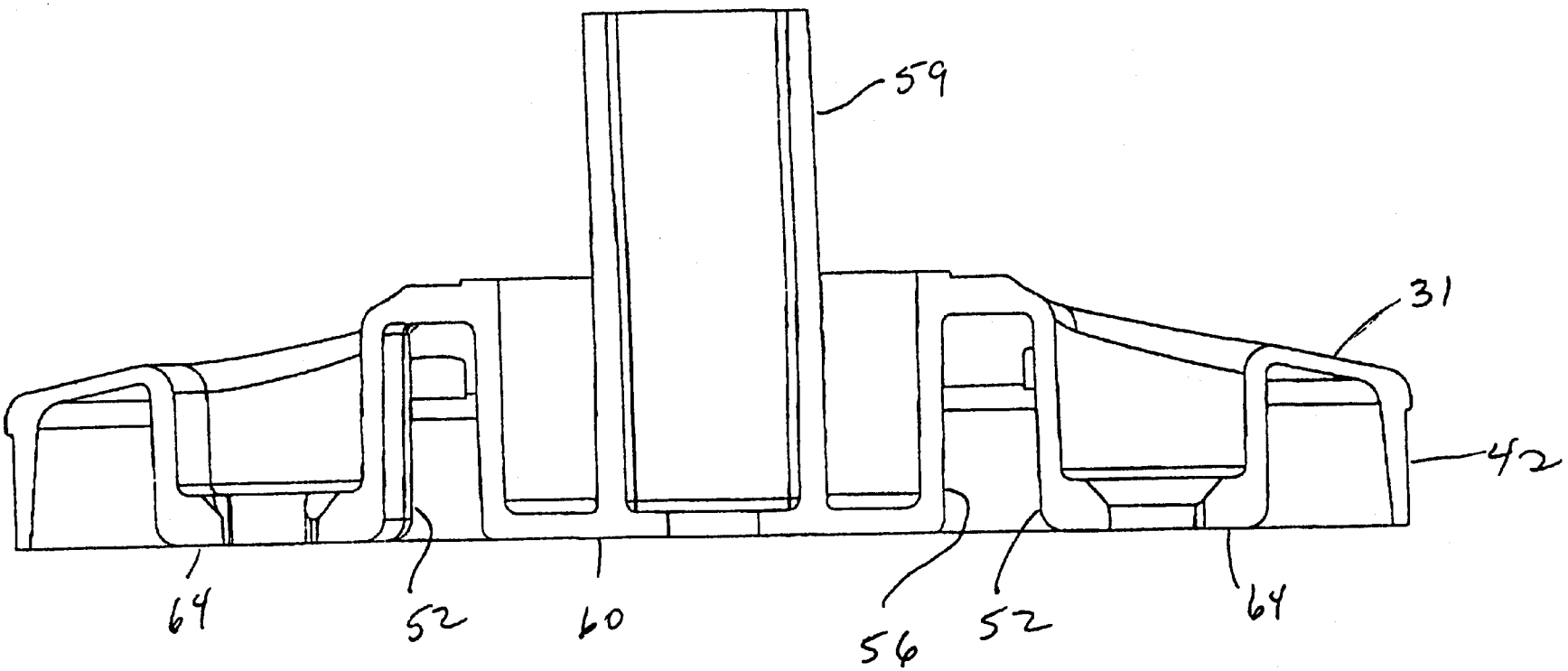
FIG. 4 is a section view taken along line 4—4 of FIG. 3.
Figure 5:
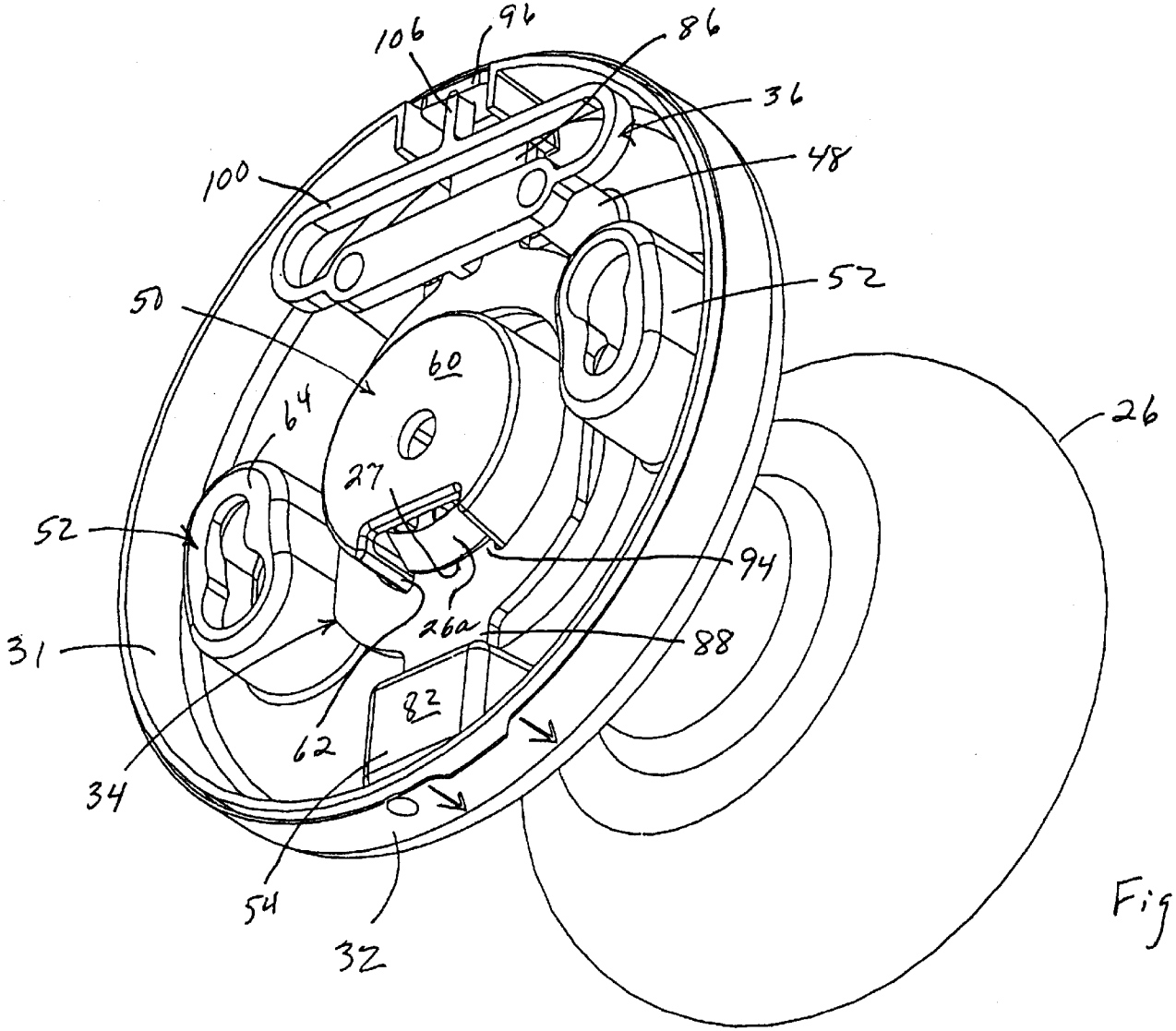
FIG. 5 is a perspective view of the interior sub-assembly of FIG. 2.

As illustrated in FIG. 1, a quick install dummy knob assembly 10 includes an exterior knob sub-assembly 12 and an interior knob sub-assembly 14. The exterior sub-assembly 12 includes an exterior doorknob 16, an exterior rose liner 20, an exterior rose cover 22, a pair of internally threaded bosses 24 extending axially from the rose liner 20 and a pair of screw 28 engaged with and extending from the bosses 24. The interior sub-assembly 14 includes an interior doorknob 26 having a knob 25 and a shank 29 with a tab-receiving slot 27, an interior rose liner sub-assembly 30 and an interior rose cover 32. As illustrated in FIG. 2, the interior rose liner sub-assembly 30 further includes a knob catch 34 and a retainer spring 36.

The interior rose liner sub-assembly 30 includes a rose liner 31 with a front wall 40 and an annular skirt 42 depending rearwardly from the front wall 40. The skirt 42 includes gap 44 at the top of the liner 30 and a mounting edge 46 that engages the surface of a door. The rose liner 31 further includes a hollow central boss 50, a pair of generally oval bosses 52, with one boss 52 disposed on either side of the central boss 50, and a lower boss 54 disposed beneath the central boss 50. In addition, two annular sleeves 48 extend rearwardly from the front wall 40, with a support bar 58 extending therebetween. All of the bosses and the sleeves extend rearwardly from the front wall 40 and, when viewed from the front of the rose liner 31, appear as recesses.

The central boss 50 includes a sidewall 56, a end wall 60, and a stem 59 extending from the end wall 60. A notch 62 is formed in the bottom portions of the sidewall 56 and end wall 60 so as to open toward the lower boss 54. Each oval boss 52 has a end wall 64 that includes a keyhole opening having a first portion 70 for receiving one of the screws 28 and a smaller second portion 72 for retaining the screw 28. The end wall 64 is thinner around the smaller, screw-retaining portion 72 of each opening to provide a recess for the screw head. The lower boss 54 includes sidewalls 74, 76, 78 and bottom wall 82, with the sidewalls 74, 76, 78 and the bottom wall 82 cooperating to define a rectangular slot 84 for receiving the knob catch 34.

The knob catch 34 is a flat plate having a central portion 84 and upper and lower axial projections 86, 88, respectively, extending from the central portion 84. The central portion 84 includes a central opening 90 and a tooth 94 that projects radially into the opening 90. The upper axial projection 86 includes a tab 96 extending orthogonally from the distal end thereof.

The retainer spring 36 includes an oval-shaped band 100 with a support plate 102 formed along one leg of the oval and means for coupling the spring 36 to the rose liner 31. A tab-engaging nib 106 extends upwardly from the band 100 to operatively engage the tab 96. The support plate 102 acts as a retainer for retaining the knob catch 34 in the interior rose liner sub-assembly 30

The means for coupling preferably includes a pair of projections 104 extending from the plate 102 and configured to be received in the annular sleeves 48. Preferably, the projections 104 include a plurality of axially extending fingers that can be collapsed radially toward each other to reduce the effective diameter of the projections 104. The collapsible fingers allow the projections to fit into the slightly smaller interior bores on the annular sleeves 48 to retain the projections 104 in position. Alternatively, the means for coupling could include projections extending from the rose liner to engage the spring 36.

The interior rose sub-assembly 30 is assembled by inserting the lower axial projection 88 of the knob catch 34 into the slot 84 in the lower boss 54 and moving the upper axial projection 86 against the support 58 that extends between the upper annular sleeves 48. In this position, the central boss 50 fits into the central opening 90 of the knob catch 34 with the tooth 94 disposed in the slot 62 formed in the central boss 50. The retainer spring 36 is installed over the knob catch 34, with the projections 104 engaging the annular sleeves 48 and the nib 106 being disposed under the tab 96 on the knob catch 34. In preferred embodiments, the projections 104 include a plurality of resilient fingers 110 that collapse radially inwardly to reduce the effective diameter of the projection 104. In the collapsed position, the fingers 110 fit snugly in the annular sleeves 48, with the resiliency of the fingers 110 adding a gripping force to retain the projections 104 in the sleeves 48. Thus, the retainer spring 36 cooperates with the lower boss 54 to retain the knob catch 34 in position while simultaneously urging the knob catch 34 into a locking position where the tooth 94 engages the knob. It will be understood that a simple friction fit or screws, pins or wedges or the like, or glue, adhesives or bonding or the like can be used to retain the projections in the annular sleeves 48.

To assemble the quick install dummy knob assembly 10, the user grasps the exterior knob sub-assembly 12 and inserts it in predrilled holes in the door with the screws 28 extending through the hole. The user then grasps the interior rose liner sub-assembly 30 and installs in by inserting the screws 28 into the larger portions 70 of the keyholes in the oval bosses 52 and rotating the sub-assembly 30 clockwise to move the screws 28 into the smaller portions 72 of the keyholes. The user then tightens down the screws 28 into the recesses surrounding the smaller portions 72 to keep the sub-assembly 30 from rotating relative to the exterior knob sub-assembly 12. The user then installs the interior rose cover 32 over the sub-assembly 30 and inserts the knob 26 into the recess formed in the backside of the central boss 50 and over the stem 59 until the tooth 94 formed on the knob catch 34 engages the slot 27 formed in the knob 26. Preferably, the knob 26 includes a knob shank with a beveled edge **26*a* that automatically engages and moves the tooth 94 downwardly against the biasing force of the retainer spring 36 to allow the knob 26 to enter the central recess. As the shank nears full insertion, the tooth 94 engages the slot 27 formed in the shank to retain the knob 26** in position.

To remove the quick install dummy knob 10, the user removes the rose cover 32 to expose the tab 96 on the knob catch 34. By pushing down on the tab 96, the user disengages the tooth 94 from the slot 27 in the knob 26, thereby moving the tooth to an unlocking position and releasing the knob, allowing the user to pull the knob 26 off of the stem 59. The user then backs off the screws 28 sufficiently to allow the interior rose liner sub-assembly 30 to rotate counterclockwise to align the screws 28 with the large portions 70 of the keyholes. The user then pulls the interior rose liner sub-assembly 30 off the screws 28 and removes the exterior knob sub-assembly 12 from the door.

The screws of the exterior knob sub-assembly can be preset at the factory to accommodate the thickness conventional door likely to be encountered, so that an installer only has to make a few turns with a screwdriver or the like to lock the interior rose liner in position, thereby speeding up installation.

It will be appreciated that the interior knob sub-assembly 14 can be installed directly onto a door without using the exterior knob sub-assembly 12 in what is referred to as a half-dummy installation. For the half-dummy installation, it is assumed that there is no throughbore in the door, and a pair of screws are screwed into the door itself. To install the half-dummy knob, the user grasps the interior rose liner sub-assembly 30 and moves it axially inwardly to engage the screws with the larger portions 70 of the keyholes and rotating the sub-assembly 30 clockwise to move the screws into the smaller portions 72 of the keyholes. The user then tightens down the screws into the recesses surrounding the smaller portions 72 to keep the sub-assembly 30 from rotating relative to the door.

The above-described embodiments, of course, are not to be construed as limiting the breadth of the present invention. Modifications and other alternative constructions will be apparent which are within the spirit and scope of the invention as defined in the appended claims.

What is claimed is:

1. A doorknob assembly comprising:

an exterior knob assembly;

an interior rose liner coupled to the exterior knob assembly and having a pair of annular sleeves and a first boss;

a knob catch having a first projection and a second projection, the first projection engaging the first boss and the second projection being disposed between the annular sleeves; and an interior knob coupled to the knob catch.

2. The assembly of claim 1 wherein the interior rose liner includes a second boss and a stem extending from the second boss and the interior knob includes a shank configured to receive the stem.

3. The assembly of claim 2 wherein the knob catch includes a central portion defining a central opening configured to receive the second boss and a tooth extending into the central opening, the second boss including a slot for receiving the tooth, the tooth extending into the slot to engage the shank.

4. The assembly of claim 1 further including a spring disposed adjacent the knob catch, wherein the knob catch includes a tab extending from the second projection and the spring engages the tab to bias the knob catch toward a locking position.

5. The assembly of claim 4 wherein the spring includes a pair of projections, the pair of projections engaging the pair of sleeves to retain the spring in position adjacent the knob catch.

6. The assembly of claim 4 wherein the interior rose liner includes an annular skirt having a gap and the tab is disposed in the gap, the tab being configured to be depressed by a user to move the knob catch from a locking position to an unlocking position to release the knob from the knob catch.

7. The assembly of claim 4 wherein the spring includes at least one projection having a plurality of fingers being resiliently collapsible to a collapsed position, the annular sleeves including a bore configured to receive the fingers in the collapsed position.

8. The assembly of claim 1 wherein the interior rose liner includes at least one second boss having a keyhole opening, the keyhole opening having a first portion for receiving a screw head and a second portion for retaining the screw head in the at least one second boss, the second portion including a recess for retaining the screw head in the second portion, the interior rose liner being rotated to move the screw head from the first portion to the second portion.

9. The assembly of claim 1 wherein the first boss includes first, second, and third sidewalls depending from the interior rose liner and a bottom wall, the bottom wall cooperating with the first, second, and third sidewalls to define a slot in the first boss for receiving the first projection.

10. A doorknob assembly comprising:

an exterior knob sub-assembly;

an interior rose liner coupled to the exterior knob assembly;

a knob catch coupled to the interior rose liner and including a tooth; and an interior knob having a shank, the shank engaging the knob catch and including a first slot for receiving the tooth to couple the knob to the interior rose liner.

11. A doorknob assembly comprising:

an exterior knob assembly;

an interior rose liner coupled to the exterior knob assembly, the rose liner including a central boss having a generally cylindrical sidewall and a bottom wall, the bottom wall and sidewall cooperating to define a second slot;

a knob catch coupled to the interior rose liner, the knob catch including a tooth, the tooth extending through the second slot to engage the first slot; and an interior knob having a shank, the shank engaging the knob catch and including a first slot for receiving the tooth to couple the knob to the interior rose liner.

12. A doorknob assembly comprising:

an exterior knob sub-assembly;

an interior rose liner coupled to the exterior knob assembly, the rose liner including a central boss having a slot and lower boss having a slot;

a knob catch coupled to the interior rose liner and including a central portion defining a central opening, a tooth extending into the central opening, and a lower projection, the lower projection engaging the slot in the lower boss while the central opening receives the central boss and the tooth engages the slot in the central boss; and an interior knob having a shank, the shank engaging the knob catch.

13. The assembly of claim 12 wherein the rose liner further includes a pair of sleeves and the knob catch includes an upper projection, the upper projection being disposed between the sleeves.

14. The assembly of claim 12 further comprising a spring coupled to the rose liner for retaining the knob catch and for biasing the knob catch into a locking position wherein the tooth engages the slot in the shank.

15. A doorknob assembly comprising:

an exterior knob sub-assembly;

an interior rose liner coupled to the exterior knob assembly;

a knob catch coupled to the interior rose liner;

an interior knob having a shank, the shank engaging the knob catch; and a retainer spring having an oval portion, a nib, and a pair of projections, wherein the rose liner further includes a pair of sleeves and the knob catch includes an upper projection having an orthogonal tab extending from a distal end of the upper projection, the pair of projections engaging the sleeves to retain the knob catch and the nib engaging the orthogonal tab to bias the knob catch toward a locking position.

16. A doorknob assembly comprising:

an exterior knob sub-assembly;

an interior rose liner coupled to the exterior knob assembly, and including a central boss having a bottom wall and a stem extending from the bottom wall;

a knob catch coupled to the interior rose liner; and an interior knob having a shank, the shank engaging the knob catch and being configured to receive the stem.

17. The assembly of claim 16 wherein the rose liner includes at least one boss disposed adjacent the central boss, the at least one boss including a keyhole having a large portion configured to pass screw head and a small portion configured to retain the screw head, the rose liner being coupled to the exterior knob assembly when the screw head is being retained in the small portion of the keyhole.

18. A doorknob assembly comprising:

an exterior knob assembly;

an interior rose liner coupled to the exterior knob assembly and including a central recess having a generally cylindrical sidewall and a bottom wall and a stem extending from the bottom wall; and an interior knob including a shank operatively disposed in the central recess and configured to receive the stem.

19. The assembly of claim 18 wherein the spring includes a retainer for retaining the knob catch in the interior rose liner.

20. The assembly of claim 19 wherein the knob catch includes means for retaining the interior knob in the recess.

21. The assembly of claim 20 wherein the knob catch includes a central portion defining a central opening and a tooth extending into the central opening and the central recess includes a slot, the tooth extending through the slot to engage the interior knob.

22. The assembly of claim 18 wherein the knob catch includes means for engaging the interior knob when the knob is disposed in the central recess.

23. The assembly of claim 22 wherein the means for engaging includes a tooth and the central recess includes a slot, the tooth extending through the slot to engage the interior knob.

24. The assembly of claim 18 wherein the exterior knob sub-assembly includes an exterior rose liner and at least one screw extending from the exterior rose liner for engaging the interior rose liner, the at least one screw having a screwhead factory set at a predetermined distance from the exterior rose liner.

25. A doorknob assembly comprising:

an exterior knob assembly;

an interior rose liner coupled to the exterior knob assembly and having a pair of annular sleeves and a lower boss;

a knob catch disposed adjacent the interior rose liner;

a retainer coupled to the interior rose liner for retaining the knob catch in position and for biasing the knob catch toward a locking position; and an interior knob coupled to the knob catch.

26. A method for installing a dummy doorknob comprising the steps of:

providing an exterior knob assembly having fasteners;

providing an interior rose liner having a central recess, openings for receiving and retaining the fasteners;

providing a knob catch disposed adjacent the interior rose liner;

providing an interior knob;

inserting the exterior doorknob assembly through a hole in a door;

aligning the openings in the interior rose liner with the fasteners;

engaging the fasteners with the holes and rotating the interior rose liner;

inserting the interior knob into the central recess and engaging the interior knob with the knob catch.

27. A doorknob assembly comprising:

an interior rose liner including a central recess having a generally cylindrical sidewall and a bottom wall and a stem extending from the bottom wall;

a knob catch disposed adjacent the interior rose liner for engaging an interior knob;

a spring disposed adjacent the knob catch for biasing the knob catch toward a locking position; and an interior knob including a shank operatively disposed in the central recess and configured to receive the stem.

28. The assembly of claim 27 wherein the spring includes a retainer for retaining the knob catch in the interior rose liner.

29. The assembly of claim 27 wherein the knob catch includes means for retaining the interior knob in the recess.

30. The assembly of claim 29 wherein the knob catch includes a central portion defining a central opening and a tooth extending into the central opening and the central recess includes a slot, the tooth extending through the slot to engage the interior knob.

31. The assembly of claim 27 wherein the knob catch includes means for engaging the interior knob when the knob is disposed in the central recess.

32. The assembly of claim 31 wherein the means for engaging includes a tooth and the central recess includes a slot, the tooth extending through the slot to engage the interior knob.

33. The assembly of claim 27 wherein the exterior knob sub-assembly includes an exterior rose liner and at least one screw extending from the exterior rose liner for engaging the interior rose liner, the at least one screw having a screwhead factory set at a predetermined distance from the exterior rose liner.

* * * * *